US010017971B2

(12) United States Patent
Craycraft et al.

(10) Patent No.: US 10,017,971 B2
(45) Date of Patent: Jul. 10, 2018

(54) METHOD OF MAKING AN APPLIANCE CABINET

(71) Applicant: Whirlpool Corporation, Benton Harbor, MI (US)

(72) Inventors: Chris S. Craycraft, Marion, OH (US); Steven J. Kuehl, Stevensville, MI (US); John E. Meddles, Marion, OH (US); Axel Julio Ramm, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 37 days.

(21) Appl. No.: 14/479,405

(22) Filed: Sep. 8, 2014

(65) Prior Publication Data

US 2015/0107084 A1 Apr. 23, 2015

Related U.S. Application Data

(60) Provisional application No. 61/894,136, filed on Oct. 22, 2013.

(51) Int. Cl.

| | |
|---|---|
| ***E05D 5/04*** | (2006.01) |
| ***E05D 9/00*** | (2006.01) |
| ***F25D 23/02*** | (2006.01) |
| ***E05D 5/02*** | (2006.01) |

(52) U.S. Cl.

CPC ..... *E05D 5/046* (2013.01); *E05D 5/02* (2013.01); *F25D 23/028* (2013.01); *E05D 9/00* (2013.01); *E05Y 2600/50* (2013.01); *E05Y 2600/506* (2013.01); *E05Y 2900/30* (2013.01); *E05Y 2900/31* (2013.01); *F25D 2323/024* (2013.01); *Y10T 29/49908* (2015.01); *Y10T 29/49915* (2015.01); *Y10T 29/49936* (2015.01)

(58) Field of Classification Search

CPC .. E05D 5/046; E05D 5/02; E05D 9/00; E05Y 2900/31; E05Y 2900/30; E05Y 2600/50; E05Y 2600/506; F25D 2323/024; Y10T 29/49908; Y10T 29/49915; Y10T 29/49936

USPC ..... 29/505, 521, 509

See application file for complete search history.

(56) References Cited

U.S. PATENT DOCUMENTS

| | | | | |
|---|---|---|---|---|
| 2,701,483 A * | 2/1955 | Foxon | B23K 20/02 | 228/115 |
| 3,452,387 A * | 7/1969 | Jerila | E05F 1/1253 | 16/49 |
| 4,043,624 A * | 8/1977 | Lindenschmidt | F25D 23/062 | 220/592.05 |
| 4,531,393 A * | 7/1985 | Weir | B21D 26/14 | 29/419.2 |
| 4,822,117 A * | 4/1989 | Boston, Jr. | F25D 23/062 | 29/455.1 |

(Continued)

FOREIGN PATENT DOCUMENTS

EP 2522798 A2 11/2012

*Primary Examiner* — Bayan Salone

(57) ABSTRACT

An appliance cabinet may be made having at least a first metallic tub, and a mounting bracket by which a component of the appliance may be mounted to the cabinet. The bracket and the first metallic tub may be juxtaposed. The bracket may be attached to the first metallic tub by moving one of a portion of the first metallic tub or the bracket at a speed great enough to induce plastic flow of the portion of the first metallic tub about a portion of the bracket.

20 Claims, 14 Drawing Sheets

(56) References Cited

U.S. PATENT DOCUMENTS 4,955,676 A * 9/1990 Weaver ..... F25D 23/069 312/236
5,020,189 A * 6/1991 Grome ..... E05D 11/1064 16/286
5,584,551 A * 12/1996 Jenkins ..... F25D 23/064 312/21
5,691,503 A * 11/1997 Kato ..... H05K 9/0073 174/375
5,975,663 A * 11/1999 Becker ..... A47B 96/00 16/374
6,389,697 B1 * 5/2002 Benoit ..... B21D 26/14 219/617
6,420,686 B1 * 7/2002 Benoit ..... B23K 13/01 219/603
6,460,955 B1 * 10/2002 Vaughan ..... B29C 66/4326 312/236
6,561,983 B2 * 5/2003 Cronin ..... A61B 17/320068 29/446
6,927,370 B2 * 8/2005 McClure ..... B21D 26/14 219/603
6,990,840 B2 * 1/2006 Park ..... B21D 26/14 29/419.2
7,108,341 B2 * 9/2006 Myers ..... F25D 23/066 312/352
7,127,775 B2 * 10/2006 Ferre ..... E05D 5/0215 16/223
7,918,118 B2 * 4/2011 Golovashchenko ... B21D 19/14 29/419.2
8,237,492 B2 * 8/2012 Au ..... H03F 3/45475 327/362
8,267,492 B2 9/2012 Lucas et al.
8,899,084 B2 * 12/2014 Yablochnikov ..... B23K 20/06 219/617
8,986,483 B2 * 3/2015 Cur ..... F25D 23/062 156/227
9,071,907 B2 * 6/2015 Kuehl ..... F25D 23/062
2005/0015931 A1 * 1/2005 Ferre ..... E05D 5/0215 16/382
2006/0249562 A1 * 11/2006 Voice ..... B23H 9/00 228/262.9
2009/0293511 A1 * 12/2009 Allard ..... F25D 19/02 62/77
2012/0080989 A1 * 4/2012 Davis ..... F25D 23/028 312/405
2013/0086961 A1 * 4/2013 Yablochnikov ..... B23K 20/06 72/56

* cited by examiner

METHOD OF MAKING AN APPLIANCE CABINET

CROSS-REFERENCE TO RELATED APPLICATIONS

This application claims the benefit of U.S. patent application No. 61/894,136, filed Oct. 22, 2013.

BACKGROUND OF THE INVENTION

For attaching components such as doors, shelf brackets, handles, and the like, an appliance cabinet may include extruded holes through a portion of a wrapper to receive fasteners. Alternatively, components may be attached to an appliance cabinet either by welding or by utilizing an adhesive. Such processes may involve fabrication of additional parts, hole formation, installation of screws or other fasteners, acquisition and use of fastening equipment, and labor, each of which may be costly.

BRIEF DESCRIPTION OF THE INVENTION

An appliance cabinet may be made having at least a first metallic tub, and a mounting bracket by which a component of the appliance may be mounted to the cabinet. The bracket and the first metallic tub may be juxtaposed. The bracket may be attached to the first metallic tub by moving one of a portion of the first metallic tub or the bracket at a speed great enough to induce plastic flow of the portion of the first metallic tub about a portion of the bracket.

DESCRIPTION OF AN EMBODIMENT OF THE INVENTION

The invention may relate to a method of joining a bracket or hinge to a metallic cabinet by high-speed movement of a portion of the metallic cabinet sufficient to induce plastic flow of the metallic portion into engagement with the bracket or hinge. Such a method may have wide application and suitability in different environments, including household and commercial refrigeration appliances, household and commercial freezers, cleaning appliances such as dryers, combination washer-dryers, fabric fresheners, and dishwashers, and other household and commercial appliances, e.g. temperature-controlled wine cellars.

The methods may be disclosed herein in connection with a household refrigeration appliance, which may share features and functionalities with known appliances. Such shared features and functionalities may not be described in detail herein except as necessary for a complete understanding of the embodiments. Furthermore, embodiments may be disclosed herein as examples only. The methods may be utilized for apparatuses and purposes other than exemplary apparatus/purposes that may be disclosed, and such apparatuses and purposes are not to be construed in any way as limiting the scope of the claims.

Figure 1:
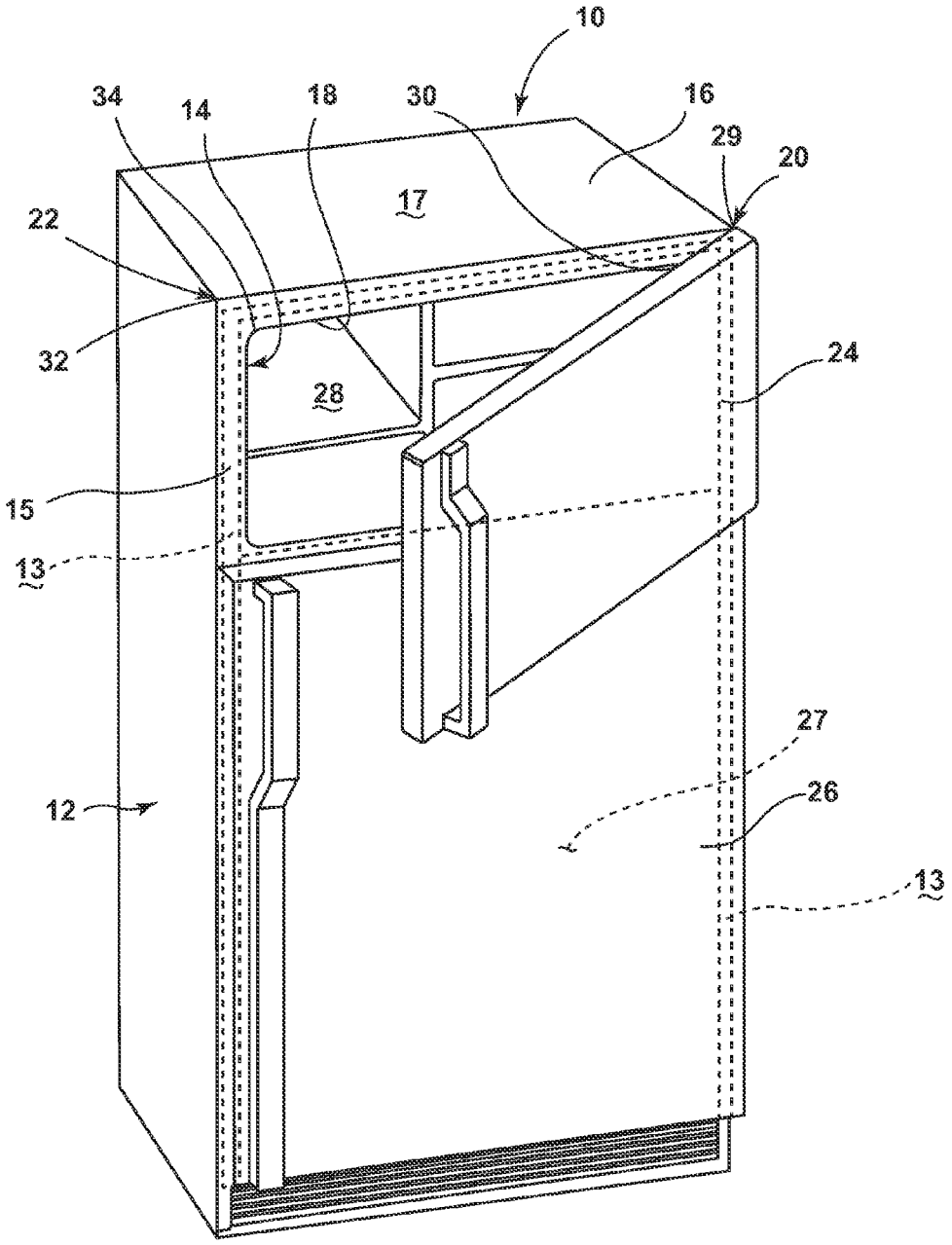
FIG. 1 is a schematic perspective view of a refrigerator cabinet illustrating outer and inner metallic tubs, with doors attached to the outer metallic tub according to an exemplary embodiment of the invention.

Referring now to FIG. 1, a first embodiment of an exemplary household refrigeration appliance may include a refrigerator cabinet 10 having a first metallic tub 12 (also referred to as an "outer tub" or "outer wrapper") disposed about a second metallic tub 14 (also referred to as an "inner tub" or "inner liner"). The outer tub 12 may be characterized, in part, by a first metallic tub top wall 16 having a top wall outer surface 17. The inner tub 14 may be characterized, in part, by a second metallic tub top wall 18. The outer tub 12 and inner tub 14 may be configured to define an intervening space 13 of generally unvarying width that may contain a suitable insulating material (not shown). The outer tub 12 may be joined to the inner tub 14 to hermetically seal the intervening space 13 containing the insulating material, and to define an integrated refrigerator cabinet 10 characterized, in part, by a generally planar obverse wall 15.

The refrigerator cabinet 10 may also be characterized, in part, by a first cabinet corner 20 comprising a first outer corner 29 and a first inner corner 30, and a second cabinet corner 22 comprising a second outer corner 32 and a second inner corner 34. The refrigerator cabinet 10 may pivotally support an upper door 24 closable against the planar obverse wall 15 along a perimeter of a frozen food compartment 28, and a lower door 26 closable against the planar obverse wall 15 along a perimeter of a fresh food compartment 27. Alternatively, other doors, e.g. a single door (not shown) or French doors, closable against the planar obverse wall 15, may be utilized for other food compartment configurations.

Brackets, plates, hinges, rail assemblies, interior light fixture supports, door closure magnets, freezer compartment and refrigeration compartment evaporator assemblies, condenser assemblies, shelving side rails, glide side adaptors, water filter housings, leveler/roller brackets, compressor mounting plate brackets, glider rail assemblies, front rail attachments, inverter module assemblies, high-voltage box assemblies, isolation valve assemblies, control board housing assemblies, needle valve assemblies, 2, 3, and 4-way valve assemblies, suction line attachments, cantilever shelving hook and ladder brackets, water line conduit monoport attachments, and the like (herein referred to collectively as "a bracket" or "brackets"), may be attached to one or both metallic tubs 12, 14 without using fasteners, such as screws, rivets, or toggle locks, as hereinafter described.

A portion of the metallic tubs 12, 14 adjacent a bracket may be moved at a speed great enough to induce plastic flow about and envelop a portion of the bracket (referred to as "high-velocity metal forming" or "HVMF"), thereby fixing the bracket to the metallic tub 12, 14. For most metals, speeds greater than about 100 meters/second (m/s) may result in plastic flow. These speeds may be approximately 100 times faster than speeds developed during traditional stamping/press brake methods, which may be about 1 m/s. Speeds great enough to induce plastic flow of selected portions of the metallic tub 12, 14 may be achieved by exposing the selected portions to a high-intensity electromagnetic force ("EMF") field. Alternatively, high-speed high-pressure waves, also referred to as "pulse waves," may induce plastic flow in the metallic tub 12, 14. Pulse waves may be generated by an instantaneous release of high-voltage current from a suitable storage device, or by triggering a controlled explosion in a pulse metal forming chamber, and directing the pulse waves against portions of the metallic tub 12, 14.

Energy for HVMF may be generated by a high-voltage controlled release of electric current from a storage apparatus, such as a bank of capacitors, to create an EMF field. A bracket may be positioned adjacent or in contact with a selected portion of the metallic tub 12, 14 by a fixture or other suitable apparatus, and selectively exposed to the EMF field, which may induce plastic flow, e.g. bending or folding, of the selected portion of the tub 12, 14 in a controlled manner to join the bracket with the tub 12, 14.

Alternatively, pulse waves may be directed toward and impact selected portions of the metallic tub 12, 14 to bend the tub portion, or drive the bracket and adjacent tub portion against a male or female mold, or around a die. Pulse waves may likewise be generated by a high-voltage instantaneous controlled release of electric current from a bank of capacitors.

Pulse waves may also be generated by a controlled vaporization of a consumable, creating an expanding plasma gas directed against the bracket and tub 12, 14. The expanding gas may be generated by a pulse metal forming apparatus that may comprise an exemplary housing (not shown) having a suitable strength, durability, and configuration for the purposes intended. A pair of elongate electrodes may extend into the housing in spaced collinear disposition. A sacrificial foil or other suitable consumable may be coupled between the electrodes for instantaneous ignition.

The electrodes may be located a selected distance away from the portion of the tub 12, 14 to be moved. Introduction of an instantaneous release of electric current across the electrodes may explosively vaporize the foil, thereby generating pulse waves directed away from the electrodes and against the tub portion. The intensity of the pulse waves may introduce plastic flow in the portions of the tub metal, and may urge the portions of the tub 12, 14 against a die or anvil, to produce a selected configuration and placement of the bracket on, or in high-strength union with, the tub 12, 14. Additional pulse waves may be selectively generated and directed toward the tub portion to complete a selected assembly.

Figure 2A:
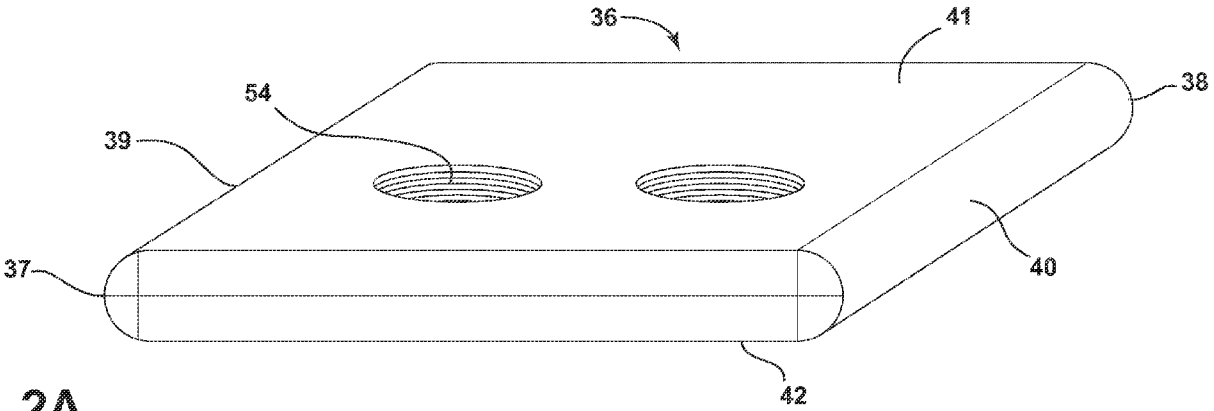
FIGS. 2A-C are enlarged schematic perspective and sectional views, respectively, of a mounting plate for attachment to an outer metallic tub according to an exemplary embodiment of the invention.
Figure 2B:
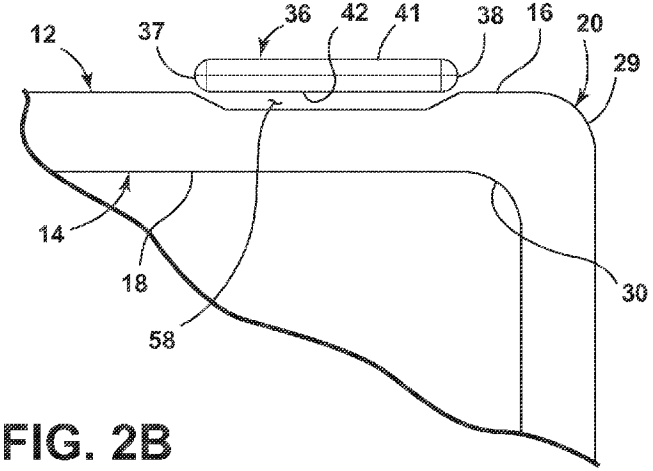
Figure 2C:
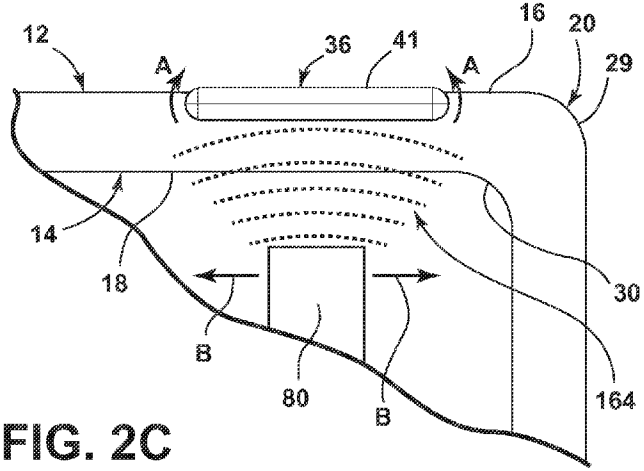

In FIGS. 2A-2C, an exemplary mounting bracket 36 may be a generally rectangular thin plate-like body characterized by a planar obverse bracket face 41, an opposed planar reverse bracket face 42, a first bracket sidewall 39, an opposed second bracket sidewall 40, a first bracket projection 37 associated with the first bracket sidewall 39, and a second bracket projection 38 associated with the second bracket sidewall 40. The mounting bracket 36 may have at least one threaded opening 54 extending orthogonally therethrough from the obverse bracket face 41.

As illustrated in FIG. 2B, a recess 58 may be formed in the first metallic tub top wall 16, having dimensions suitable for receiving the mounting bracket 36 therein and enabling the first metallic tub top wall 16 to overlap the bracket projections 37, 38. Alternatively, the recess 58 may be omitted, and the mounting bracket 36 may be initially disposed in contact with the planar top wall 16. With either alternative, an HVMF generator 80 may be utilized to wrap the first metallic tub top wall 16 about the mounting bracket 36. Pulse waves may be generated by an instantaneous release of high-voltage current from a suitable storage device, or by triggering a controlled explosion in a pulse metal forming chamber, and directing the pulse waves against selected portions of the metallic tub 12, 14.

A suitable fixture (not shown) may hold the mounting bracket 36 in a selected orientation relative to the top wall 16, which may facilitate alignment of the mounting bracket 36 with the recess 58 or planar top wall 16, and minimize unintended movement of the bracket 36 during the HVMF process. If the fixture is movable, joining of the bracket 36 with the tub 12, 14 may be facilitated by holding the tub 12, 14 in a fixed position and moving the fixture to subject the bracket 36 to the plastic flow of the tub material. High-velocity movement of the bracket 36 into the recess 58 or against the planar top wall 16 may contemporaneously induce plastic flow of the tub material associated with the bracket movement. As the bracket 36 progressively engages the tub material, plastic flow about the mounting bracket 36 may be induced in the tub material adjacent the bracket 36. High-velocity bracket movement may be induced by pulse waves directed against the bracket 36. The pulse waves may be generated by an instantaneous release of high-voltage current from a suitable storage device, or by triggering a controlled explosion in a pulse metal forming chamber, and directing the pulse waves against the bracket 36.

FIG. 2C illustrates the mounting bracket 36 in the recess 58 during overlapping movement of the top wall 16, shown by the metal motion vectors A. The top wall 16 may be moved so that the top wall outer surface 17 may be flush with the obverse bracket face 41 under the influence of an electromagnetic force field 164. The electromagnetic force field 164 may be generated by the high-velocity metal forming generator 80 movable along up to 3 orthogonal axes relative to the mounting bracket 36, exemplified by the generator motion vectors B. A suitable fixture (not shown) may be configured to hold the mounting bracket 36 to the first metallic tub top wall 16 so that the generator 80 may accurately direct the electromagnetic force field 164 to the mounting bracket 36 from adjacent the outer tub 12.

The high-velocity metal forming generator 80 may be alternatively positionable adjacent the second metallic tub top wall 18 so that the electromagnetic force field 164 may engage the first metallic tub top wall 16 adjacent the mounting bracket 36. The generator 80 may be stationary so that the cabinet portion and bracket may be moved relative to the generator 80, or movable along up to three axes so that the cabinet portion and bracket 36 may remain stationary during HVMF. The mounting bracket 36 may be joined to the first metallic tub top wall 16 prior to joining the outer tub 12 and the inner tub 14. A component, such as a hinge (not shown), may be fixedly attached to the mounting bracket 36 by suitable fasteners inserted through openings in a hinge plate and threaded into the threaded openings 54.

Figure 3:
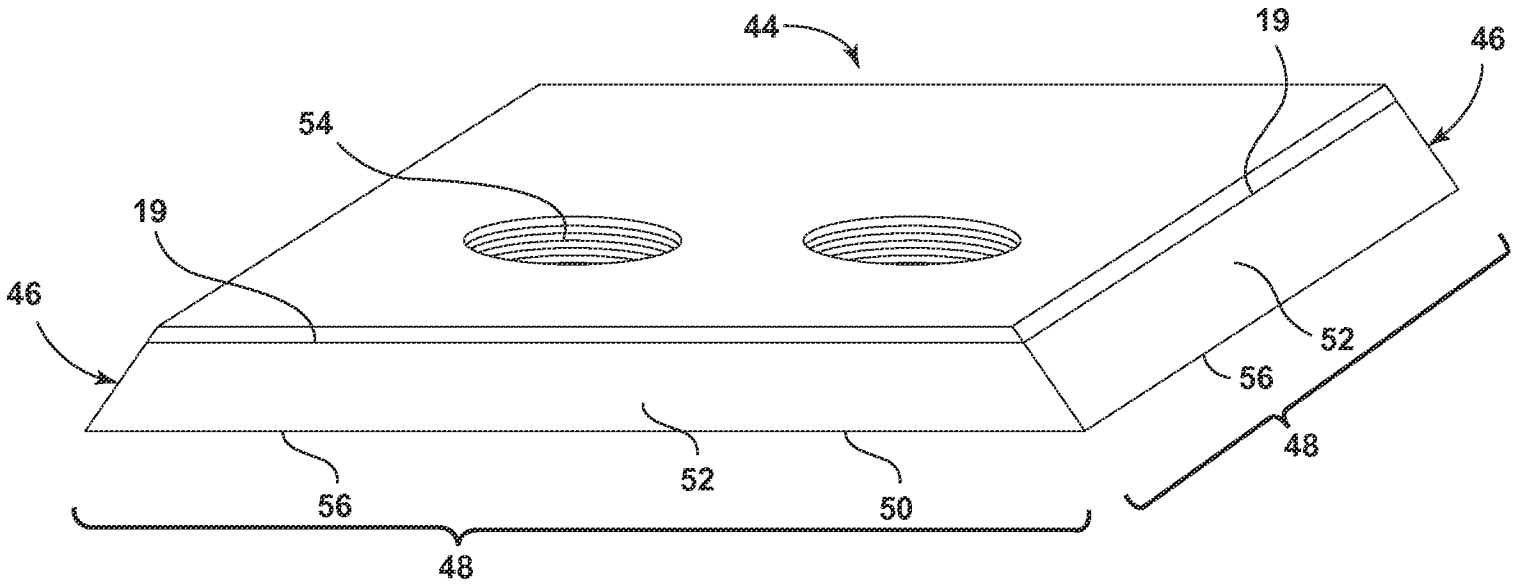
FIG. 3 is a schematic perspective view of an alternative mounting plate for attachment to an outer metallic tub according to an exemplary embodiment of the invention.

An alternative embodiment mounting bracket 44 is illustrated in FIG. 3. The mounting bracket 44 may be a generally rectangular thin plate-like body characterized, in part, by an opposed planar reverse bracket face 50, four bracket sidewalls 48, and at least one threaded opening 54 extending orthogonally toward the reverse bracket face 50. The bracket sidewalls 48 may each have a planar beveled surface 52 defining a bracket projection 46 terminating in a side edge 56. The mounting bracket 44 may be fixedly attached to the refrigerator cabinet 10 utilizing a recess formed in the first metallic tub top wall 16 having dimensions suitable for receiving the mounting bracket 44 therein. Alternatively, the recess 58 may be omitted, and the mounting bracket 44 may be disposed in contact with the planar top wall 16. A portion of the top wall 16 subjected to HVMF may plastically flow to overlap the bracket projection 46, generally as described hereinbefore.

The outer tub 12 may plastically flow along the beveled surfaces 52 to a pre-selected height, e.g. illustrated by a pre-selected metallic tub wall limit line 19. FIG. 3 illustrates the tub wall limit line 19 extending along the beveled surfaces 52 somewhat below the upper face of the mounting bracket 44. Consequently, the mounting bracket 44 may extend above the first metallic tub top wall 16. Alternatively, the top wall 16 may plastically flow around and along the beveled surfaces 52 so that the top wall 16 may be flush with the mounting bracket 44.

Alternatively, the bracket may be moved into the tub material at a high speed, utilizing any of the aforementioned methods and apparatuses, with suitable fixturing to provide a preselected fixed alignment of the tub and bracket, and to limit the depth of insertion of the bracket into the tub and/or the path length of plastic flow of the tub material.

Figure 4:
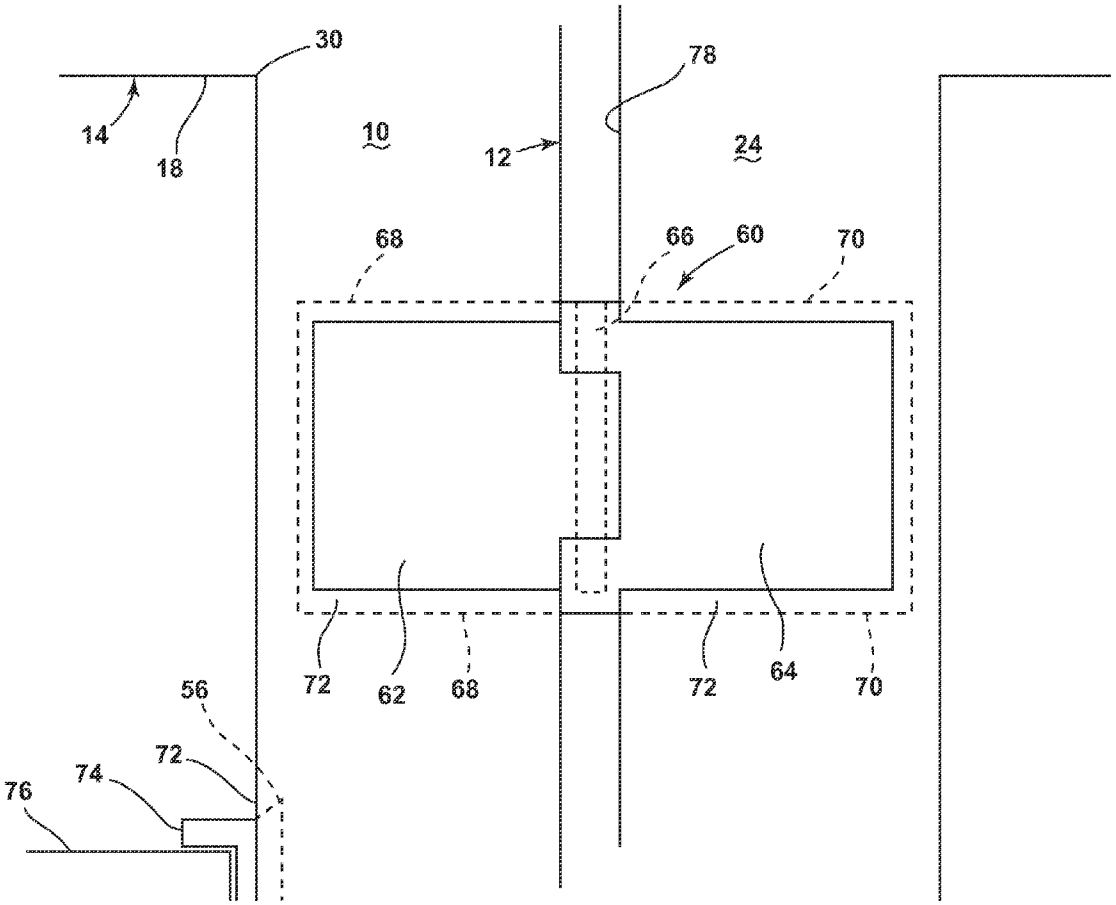
FIG. 4 is a schematic elevation view of a portion of a refrigerator cabinet and a door pivotally coupled thereto having a hinge attached according to an embodiment of the invention.

FIG. 4 illustrates a door hinge 60 that may comprise a cabinet hinge plate 62 and a door hinge plate 64 pivotally coupled by a hinge pin 66. The cabinet hinge plate 62 may be characterized by a perimetric cabinet hinge plate edge 68. The door hinge plate 64 may be characterized by a perimetric door hinge plate edge 70. The door hinge 60 may straddle a space defined by an edge 78 of the upper door 24 and by the outer tub 12. The cabinet hinge plate 62 may be fixedly attached to the metallic planar obverse wall 15 of the refrigerator cabinet 10 by moving the wall 15 in plastic flow around and along the perimetric edge 68, generally as described hereinbefore. The cabinet hinge plate 62 may be characterized by beveled edges to facilitate attachment of the hinge plate 62 with the metallic planar obverse wall 15.

Similarly, the door hinge plate 64 may be fixedly attached to the upper door 24 by moving a portion of the door 24 adjacent the perimetric door hinge plate edge 70 in plastic flow around and along the perimetric edge 70, generally as described hereinbefore. The door hinge plate 64 may be characterized by beveled edges to facilitate attachment of the hinge plate 64 with the upper door 74. The described HVMF method may also be utilized to attach a rail assembly to a portion of the inner tub 14 for supporting a shelf 76, and comprising at least one shelf bracket 74. The shelf bracket 74 may have beveled edges 56 so that the shelf bracket 74 may be "locked" to the inner tub 14 by plastic flow 72 of the inner tub 14 along the perimeter of the shelf bracket 74.

Figure 5:
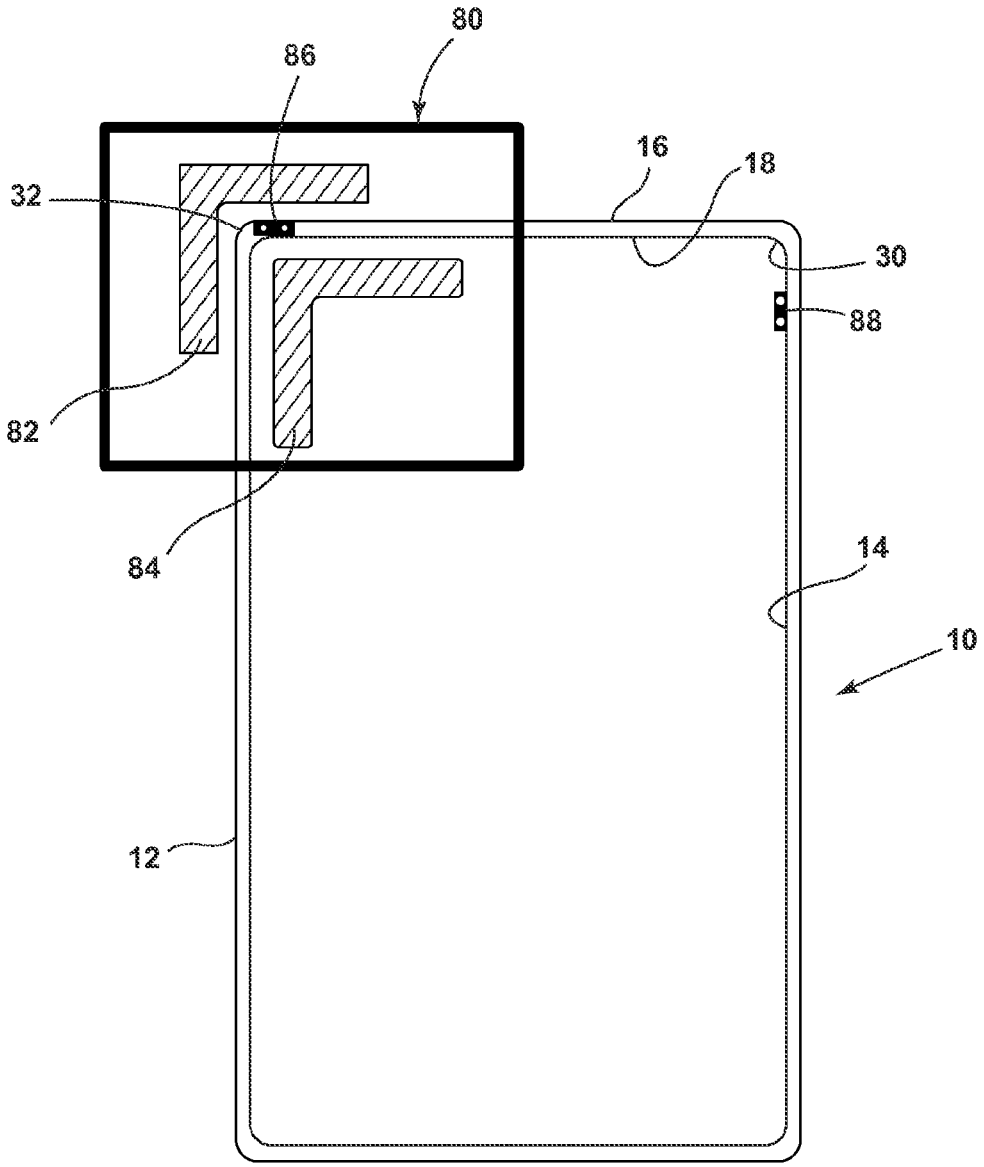
FIG. 5 is a schematic plan view of outer and inner metallic tubs and a metal forming apparatus configured for attachment of a first hinge and a second hinge to the outer metallic tub and the inner metallic tub, respectively.

Referring now to FIG. 5, an HVMF generator 80 for generating an electromagnetic force field may be configured for installation of a bracket, such as an exemplary hinge 86, 88 at or near a corner of the refrigerator cabinet 10. An HVMF generator 80 may have any suitable configuration for the purposes intended; in FIG. 5, an exemplary generator 80 may comprise a movable corner die 82 and a movable corner driver 84. The corner die 82 may be configured to be brought into contact with the second outer corner 32 of the outer tub 12, thereby holding the hinge 86 in a selected position. The corner driver 84 may be configured and actuated for generation of an electromagnetic force field to induce plastic flow in and move a portion of the outer tub 12 around the bracket 86, as hereinbefore described. Concurrently, other work may be performed by the generator 80, such as sharpening the second outer corner 32, i.e., reducing the corner radius.

The exemplary hinge 86 is illustrated as coupled with the second outer corner 32. However, a bracket may be coupled with other cabinet components in accordance with its planned utilization. For example, the exemplary hinge 88 is illustrated as coupled with the inner tub 14 somewhat below the first inner corner 30. This location may be better suited for attachment of components within a frozen food compartment or fresh food compartment. Regardless of location, the exemplary hinge 88 may be coupled with the inner tub 14 in a suitable manner, as hereinbefore described.

The generator 80 may be configured so that the movable corner die 82 may be positioned inside the cabinet 10, and the movable corner driver 84 may be positioned outside the cabinet 10, during the HVMF process. The generator 80 may be moved from one corner to another in a suitable manner, such as perpendicular to the planar obverse wall 15, i.e. the front face of the cabinet 10, and may be adapted for linear and rotational movement to enable controlled positioning of the generator 80 relative to a corner to be worked.

High-speed coupling of a bracket into a metallic surface generally as described herein may eliminate a separate manufacturing step, such as drilling and threading of openings, sealing of openings after installation of brackets, welding of brackets to a metallic surface, and the like. High-speed coupling may also minimize disruptions in hermetic seals associated with conventional attachment of brackets. Fixtures such as drawer glides, motor brackets, compressor brackets, and the like, may also be coupled into a metallic surface, generally as described herein, which may thereby eliminate one or more separate manufacturing steps and reduce manufacturing time and costs. High-speed coupling may be conducted at one or more selected times in the cabinet fabrication process utilizing the herein described methods depending upon the location, shape, and accessibility of the bracket/fixture to the HVMF generator.

Figure 6:
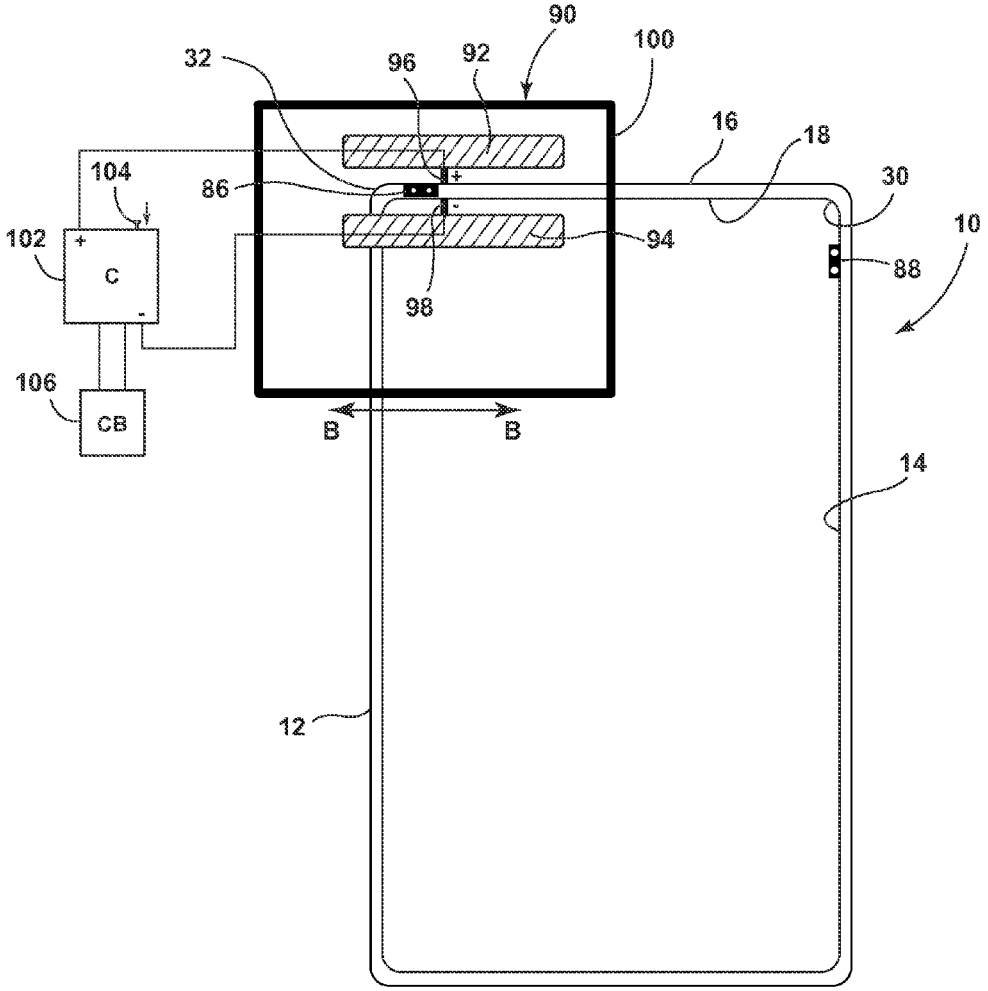
FIG. 6 is a schematic plan view similar to FIG. 5 of an alternate metal forming apparatus configured for attachment of a first hinge and a second hinge to an outer metallic tub and an inner metallic tub, respectively.

Referring now to FIG. 6, an alternate exemplary embodiment of a generator 90 for generating high-pressure waves may be configured for installation of a bracket, such as an exemplary hinge 86, 88 to the refrigerator cabinet 10. The exemplary high-pressure wave generator 90 may have any suitable configuration for the purposes intended; in FIG. 6, the exemplary generator 90 may comprise an outer electrode carriage 92 and an inner electrode carriage 94 in spaced disposition to enable the carriages 92, 94 to be positioned on both sides of the refrigerator cabinet 10. The outer electrode carriage 92 may support a cathode 96 and the inner electrode carriage 94 may support an anode 98 in spaced disposition suitable for the generation of high-pressure waves. The carriages 92, 94 may comprise a portion of a combustion chamber 100 within which the high pressure waves may be generated and focused.

The generator 90 may be movable along the perimeter walls of the refrigerator cabinet 10, as exemplified by the generator motion vectors B, and may be adapted for linear and rotational movement to enable controlled positioning of the generator at a location on the cabinet 10 to be worked. The cathode 96 and anode 98 may be electrically coupled to a suitable controller 102 having an ignition trigger 104 for initiating an explosion within the generator 90. The controller 102 may be electrically coupled to a suitable source of high-voltage current, such as a bank of capacitors 106.

Figure 7:
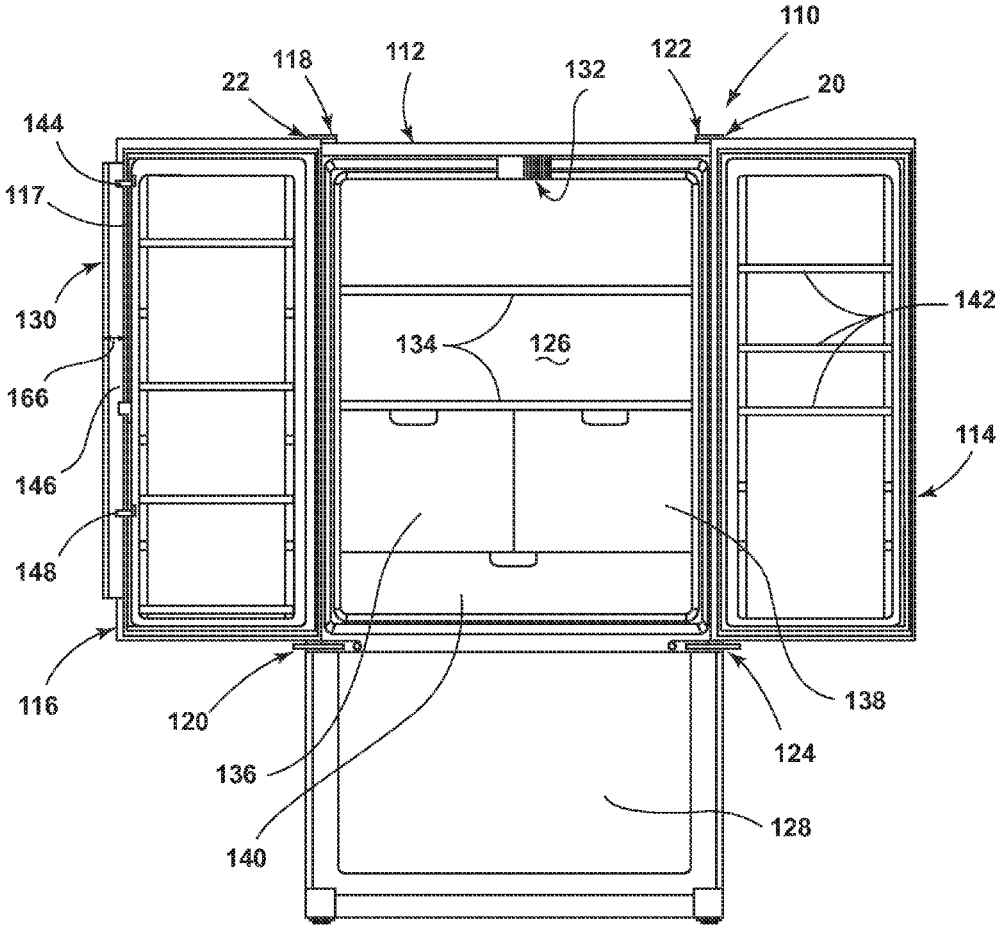
FIG. 7 is a front elevation view of the interior of a French-door refrigerator with open doors according to an alternative embodiment of the invention.

FIG. 7 illustrates an alternate embodiment comprising a French-door refrigerator 110 that may have a cabinet 112 including a first door 114 and a second door 116 pivotally coupled with the cabinet 112. Attached to the cabinet 112 may be an upper left side hinge 118 and a lower left side hinge 124 pivotally supporting the second door 116, and an upper right side hinge at 122 and a lower right side hinge 124 pivotally supporting the first door 114. The doors 114, 116 may close a fresh food compartment 126. A frozen food compartment 128 may be located beneath the fresh food compartment 126. The fresh food compartment 126 may include shelves 134 and food bins 136, 138, 140. The doors 114, 116 may include door shelves 142.

Figure 8:
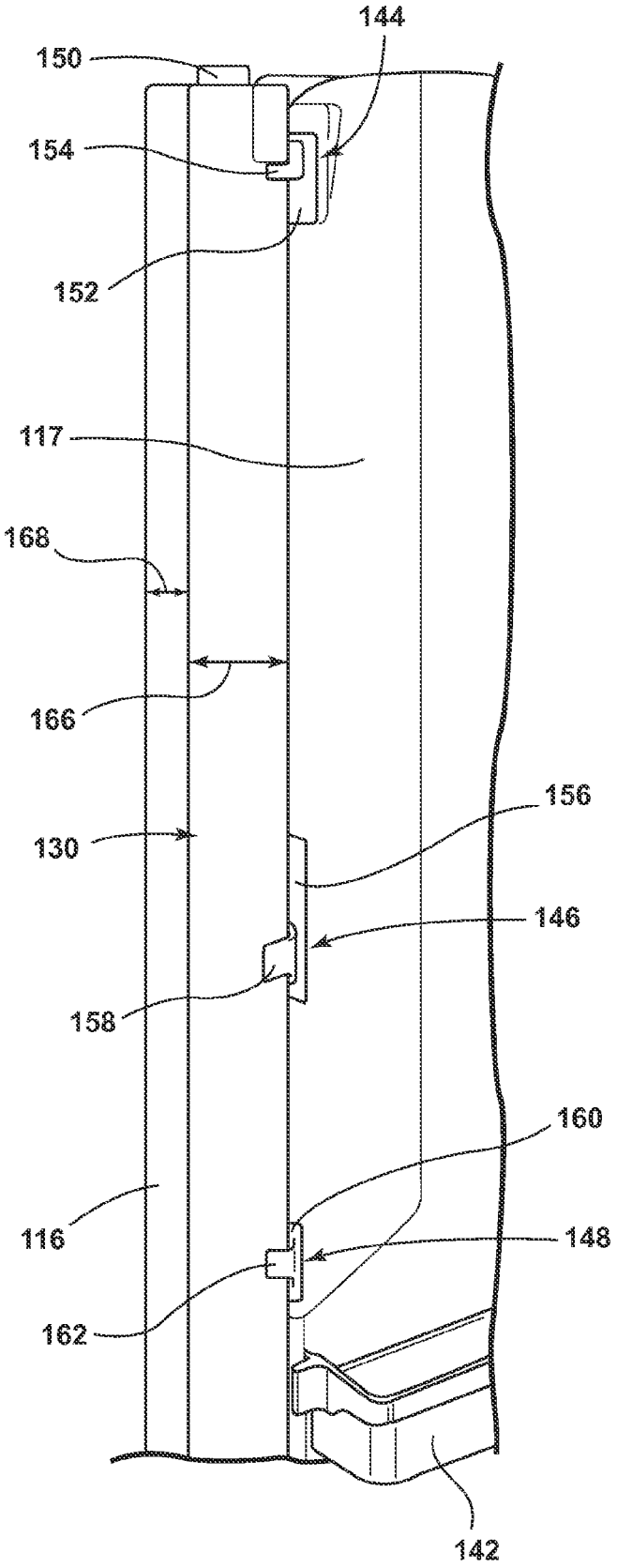
FIG. 8 is an enlarged vertical perspective view of the refrigerator of FIG. 7 illustrating a door mullion pivotally attached to a French door according to an embodiment of the invention.

The second door 116 may have a second door edge 117 that may pivotally support a mullion 130 for sealing a gap separating the doors 114, 116 when closed. Referring also to FIG. 8, the mullion 130 may comprise an elongated member having a mullion width 166, i.e. the transverse dimension bridging the gap, somewhat greater than a mullion depth 168, i.e. the transverse dimension orthogonal to the width 166, pivotally attached to a longitudinally disposed free edge 117 of the second door 116 through an upper mullion hinge 144, a middle mullion hinge 146, and a bottom mullion hinge 148. The upper mullion hinge 144 may comprise an upper mullion hinge plate 152 transitioning orthogonally to a somewhat elongate upper mullion cantilevered hinge arm 154. The middle mullion hinge 146 may comprise a middle mullion hinge plate 156 transitioning orthogonally to a somewhat elongate middle mullion cantilevered hinge arm 158. The bottom mullion hinge 148 may comprise a bottom mullion hinge plate 160 transitioning orthogonally to a somewhat elongate bottom mullion cantilevered hinge arm 162.

The mullion hinge plates 152, 156, 160 may each have a somewhat flattened profile and suitable areal dimensions so that adjacent metal, e.g. metal comprising the edge 117 of the second door 116, may be induced to move at high speed to flow plastically against and around the hinge plates 152, 156, 160, thereby resulting in a fixed attachment of the hinge plates to the second door edge 117. The hinge plates 152, 156, 160 may have rounded or beveled edges, such as illustrated in FIGS. 2A and 3, to facilitate "locking" of the hinge plates 152, 156, 160 to the second door edge 117.

The free end of each cantilevered hinge arm 154, 158, 162 may be configured with a circular opening (not shown) so that attachment of the hinge plates 152, 156, 160 to the second door 116 may align the circular openings concentrically along the second door edge 117. Each mullion hinge arm 154, 158, 162 may extend into a suitable receptacle (not shown) in the mullion 130 to be pivotally coupled with the mullion 130 by pins (not shown). The coupling of the hinge arms 154, 158, 162 with the mullion 130 may enable pivotal movement of the mullion 130 relative to the second door edge 117.

The French-door refrigerator cabinet 112 may be provided with a mullion rotation receptacle 132 at a suitable location to receive a mullion rotation boss 150 extending longitudinally from the upper end of the mullion 130.

Figure 9:
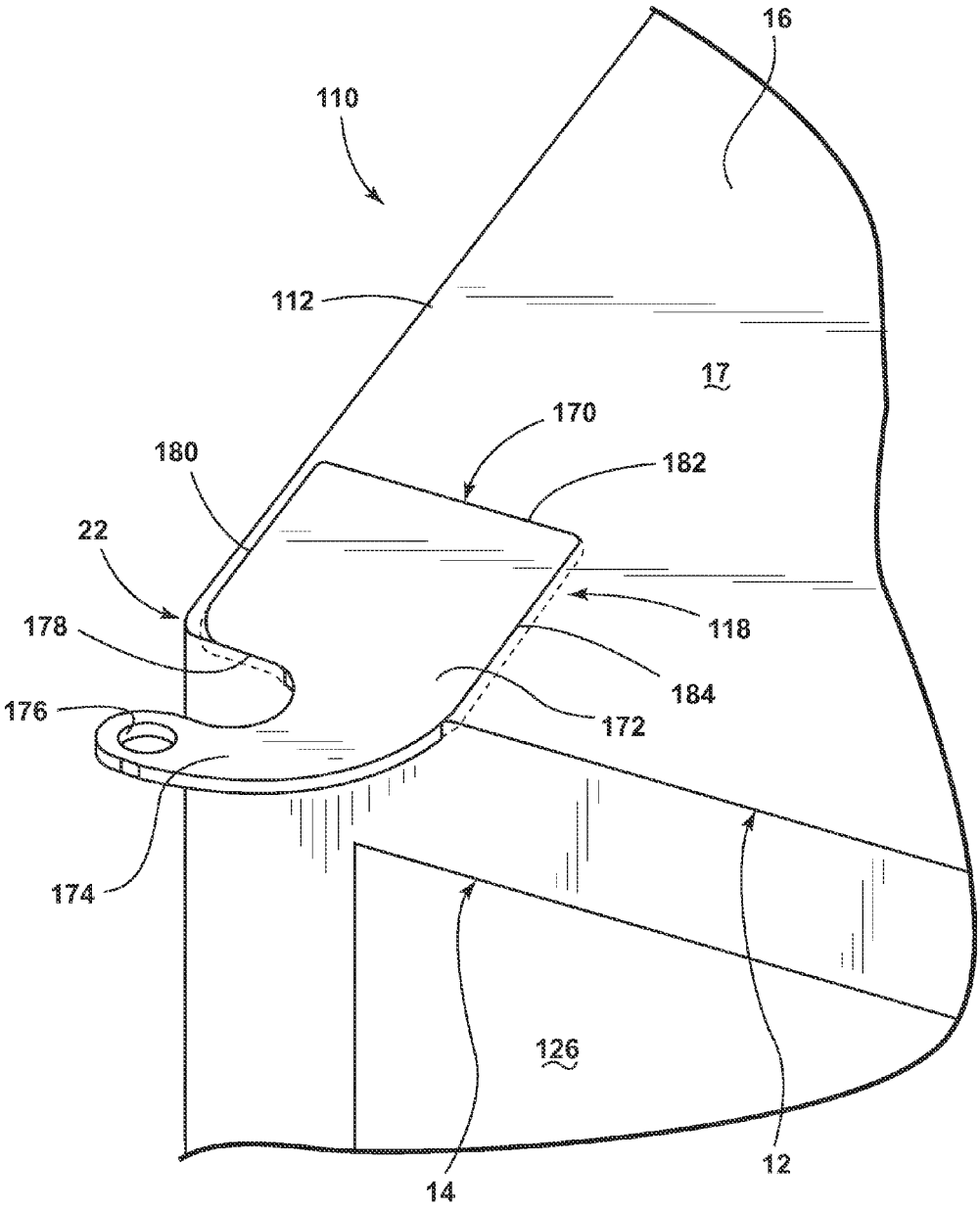
FIG. 9 is an enlarged perspective view of a hinge plate coupled with an outer metallic tub according to an embodiment of the invention.

Referring now to FIG. 9, a hinge plate 170 may be attached to the first metallic tub top wall 16 at a second cabinet corner 22 of the French-door refrigerator cabinet 112. The hinge plate 170 may be a somewhat irregularly-shaped flattened body comprising a somewhat rectangular anchor plate 172 characterized by an obverse sidewall 178, an outer sidewall 180, a rearward sidewall 182, and an inner sidewall 184. The anchor plate 172 may transition coplanarly along the obverse sidewall 178 to a flattened curved hinge arm 174 having a thickness generally equal to a thickness of the anchor plate 172 and terminating in a hinge pin opening 176.

The hinge plate 170 may be coupled with the cabinet 112 by utilizing a hereinbefore described method for moving portions of the first metallic tub top wall 16 adjacent the hinge plate 170 at a high speed, thereby inducing plastic flow of the metallic surface against and around the anchor plate 172. The sidewalls 178, 180, 182, 184 may have a rounded or beveled configuration as illustrated in FIGS. 2A and 3 to facilitate "locking" of the anchor plate 172 to the cabinet 112.

An example of an installation that may be utilized for the processes described hereinbefore may include a production cell having EMF equipment, such as capacitors, coils, controllers, and the like, built inside a framework, with specific component tooling. A suitable supply of cabinets, brackets and/or hinges may be made available to facilitate optimal efficiency. A cabinet or door may be positioned with a bracket or hinge into a suitable fixture. An operator may then actuate the process, and subsequently remove the joined parts.

Figure 10:
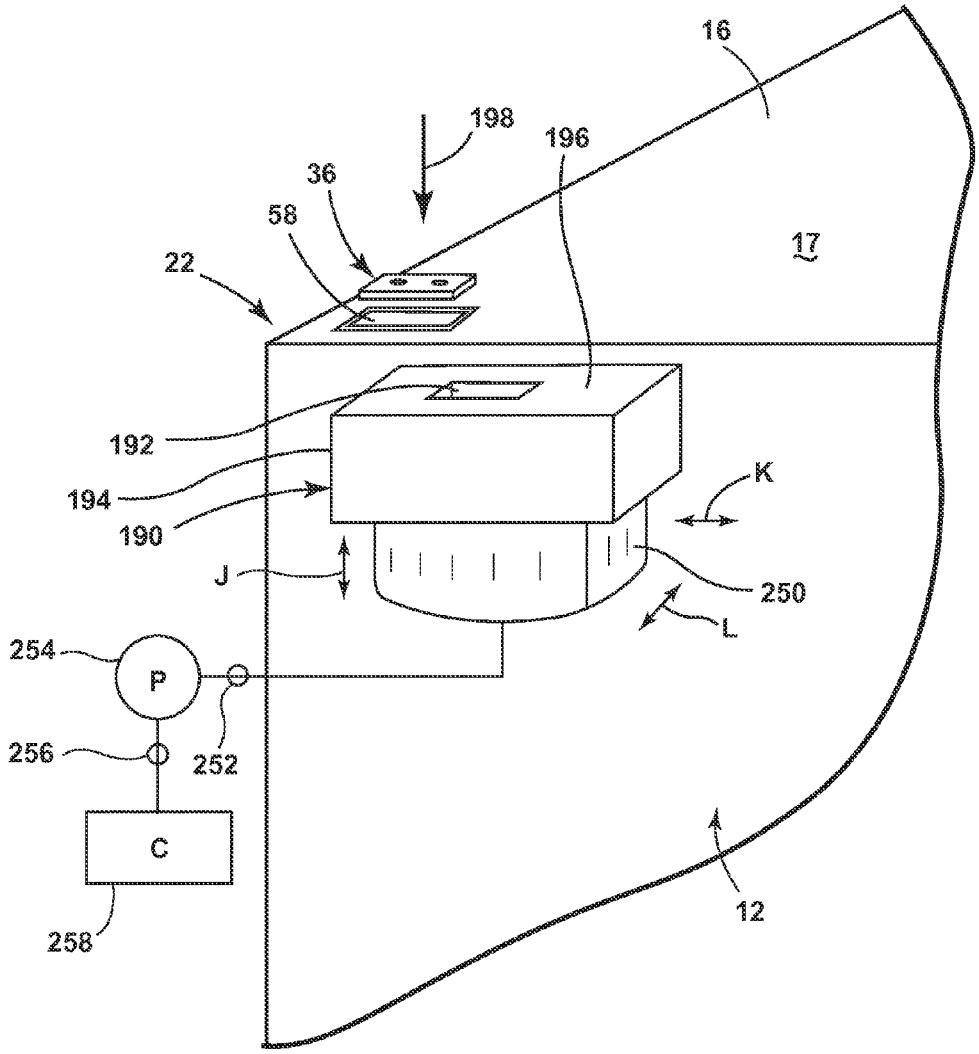
FIG. 10 is a schematic perspective view of a corner portion of a cabinet illustrating a bracket recess supportable by a recess fixture according to an alternative embodiment of the invention.

Referring now to FIG. 10, an alternate exemplary embodiment of the invention utilizing pulse waves may comprise moving the bracket 36 against the outer wrapper 12 and into a "female die," also referred to herein as a "fixture block 190." The fixture block 190 may be selectively positionable adjacent a side of the outer wrapper 12 so that the bracket 36 may be adjacent the opposite side of the outer wrapper 12. The fixture block 190 may hold, and control the flow characteristics of, the outer wrapper 12 as the bracket 36 is driven by the EMF or pulse wave. The fixture block 190 may facilitate formation of the recess 58 in the top wall 16 of the outer wrapper 12. It may be understood that formation of the recess 58 in the top wall 16 of the outer wrapper 12 is merely exemplary, and should not be construed as limiting in any way the scope of the claims. Formation of a recess according to the following embodiments may be accomplished at any location along the cabinet.

FIG. 10 illustrates a portion of the outer wrapper 12 characterized by the second cabinet corner 22 at which the outer wrapper top wall 16 may orthogonally join the outer wrapper's left sidewall 21. The fixture block 190 may be a cuboid partially characterized by a fixture block sidewall 194 and a fixture block top wall 196. The fixture block 190 may be fabricated of a material having sufficient strength and durability, and suitable electromagnetic properties, for the purposes intended.

The fixture block top wall 196 may have a recess cavity 192 which may facilitate formation of the recess 58. For example, the position of the fixture block 190 relative to the outer wrapper 12 may be adjustable along up to 3 mutually orthogonal axes to controllably position the recess cavity 192 at a selected location for the recess 58. Thus, the fixture block 190 may be translated toward the outer wrapper top wall 16 as represented by the fixture block translation vector J, toward the outer wrapper left sidewall 21 as represented by the fixture block translation vector K, and along an axis orthogonal to the translation vectors J and K as represented by the fixture block translation vector L.

The fixture block 190 may be positioned utilizing known apparatuses, such as a mechanical, hydraulic, or pneumatic system, or a combination of such systems. An exemplary hydraulic system may include a fixture block positioner 250 to which the fixture block 190 may be removably coupled. The exemplary hydraulic system may include one or more hydraulic lines 252 fluidly coupling the fixture block positioner 250 with a hydraulic pump 254. The hydraulic pump 254, and the fixture block positioner 250, may be controlled through a suitable controller 258 electrically coupled with the hydraulic pump 254. The controller 258 may incorporate integrated circuitry and a user interface (neither shown) for facilitating controlled operation of the exemplary hydraulic system.

When the fixture block 190 has been selectively positioned relative to the outer wrapper 12, the recess 58 may be formed initially by utilizing an HVMF method, represented by the HVMF force vector 198, generally as hereinbefore described. Alternatively, the recess 58 may be formed through a known stamping process, such as die forming, drawing, and the like. In yet another alternative, the recess 58 may be formed contemporaneously with joining of the bracket 36 to the outer wrapper 12.

Whether the recess 58 may be formed prior to or contemporaneously with joining of the bracket 36 to the outer wrapper 12, pulse waves may be produced generally as previously described herein to drive the bracket 36 into the recess 58 while a portion of the outer wrapper 12 adjacent the recess 58 may flow plastically about and along the perimeter of the bracket 36.

Figure 11A:
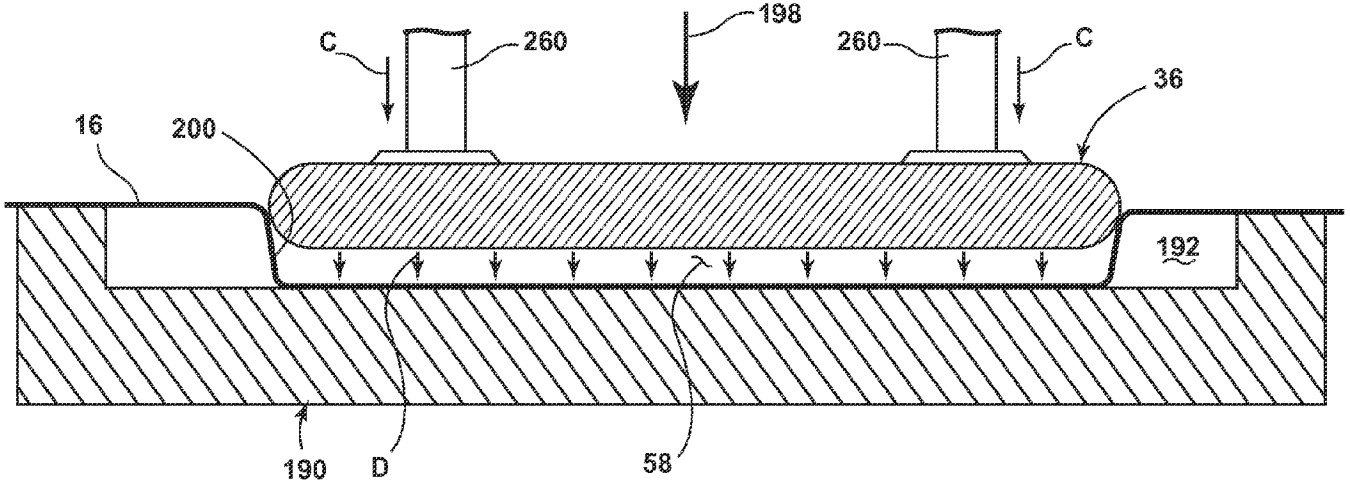
FIG. 11A-B are schematic side views of a first bracket driven by an HVMF force into a bracket recess against a recess fixture according to another embodiment of the invention.
Figure 11B:
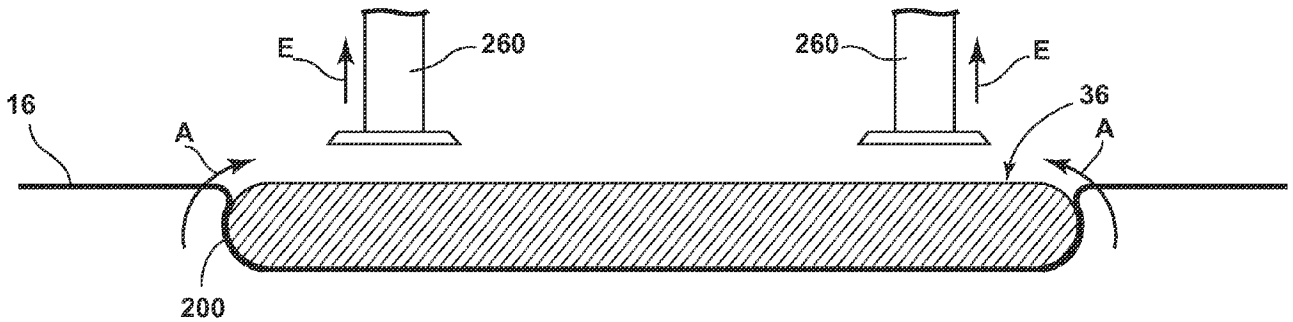

Referring now to FIGS. 11A and 11B, an HVMF setup is illustrated that may include a bracket 36 characterized by perimetric sidewalls 39, 40, a fixture block 190 with a recess cavity 192, an outer wrapper top wall 16 having a recess 58 characterized by perimetric sidewalls 200, and a partially illustrated bracket holder 260. The HVMF setup may also include a pulse wave generator for producing pulse waves generally as previously described herein. The HVMF setup may also include components that may share features and functionalities with the apparatus illustrated in FIGS. 2A-2C. In FIGS. 2A-2C, the outer wrapper 12 may lie between the HVMF generator and the bracket 36, and the EMF 198 may be directed through the outer wrapper 12 to the bracket 36. In contrast, in FIGS. 11A and 11B, the bracket 36 may lie between the outer wrapper 12 and the HVMF generator, represented by the EMF vector 198. After selective positioning, the EMF 198 may drive the bracket 36 into the recess 58, as exemplified by the bracket motion vectors D.

The bracket holder 260 may be configured to enable controllable positioning in up to 3 mutually orthogonal axes. For example, the bracket holder 260 may enable positioning of a bracket 36 selectively toward or away from the recess 58 or recess cavity 192, as exemplified by the bracket fixture motion vectors C and E, respectively. The bracket holder 260 may additionally enable controllable positioning parallel to the recess 58 or recess cavity 192. Controllable positioning may be accomplished utilizing known apparatuses, such as a mechanical, hydraulic, or pneumatic system, or a combination of such systems.

Though not shown, the bracket holder 260 may support an HVMF generator, which may selectively move with, or independently of, the bracket holder 260. The bracket holder 260 may support the bracket 36 utilizing a suitable means (not shown), e.g. through the application of a vacuum delivered through suitable conduits, or utilizing mechanical devices capable of locking the bracket 36 to the bracket holder 260. Other attachment means may be utilized, provided that the bracket 36, and the portion of the bracket holder 260 attached to the bracket 36, may be movable in response to EMF generated by the HVMF generator, as exemplified by the bracket motion vectors D.

Under the influence of the EMF, the outer wrapper 12 adjacent the recess 58 may flow plastically inward to enfold the bracket edges and fix the bracket 36 to the outer wrapper top wall 16, as illustrated in FIG. 11B. Upon completion of the HVMF operation, the bracket holder 260 may be released from the bracket 36, and repositioned for a subsequent HVMF process, as exemplified by the bracket fixture motion vectors E.

Figure 12A:
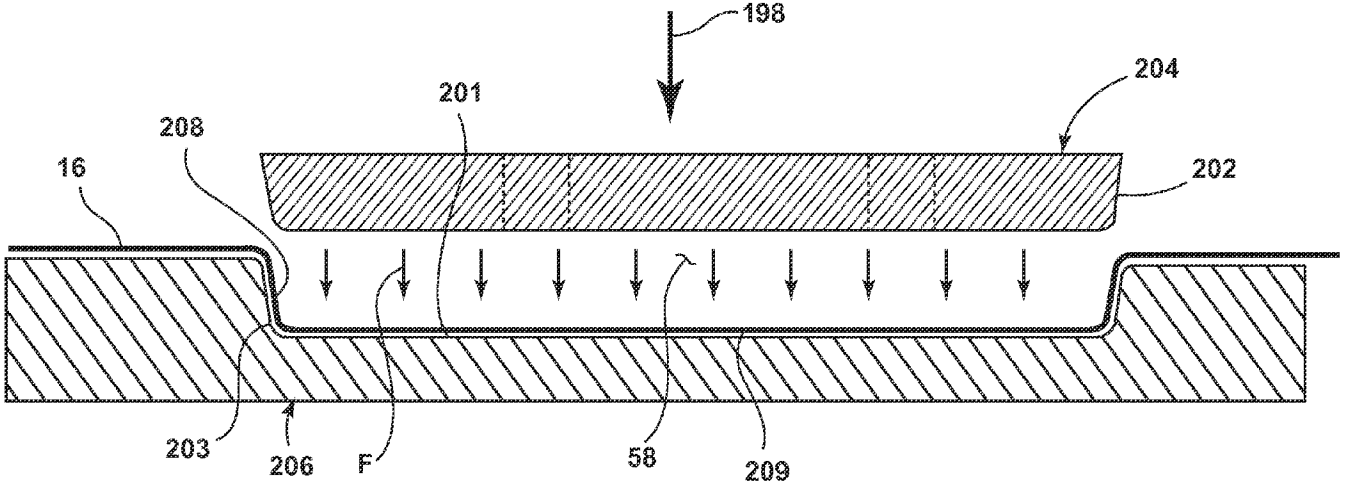
FIG. 12A-B are schematic side views of a first bracket driven by an HVMF force into a bracket recess to generate friction and form a perimetric weld between the bracket walls and recess walls according to an embodiment of the invention.
Figure 12B:
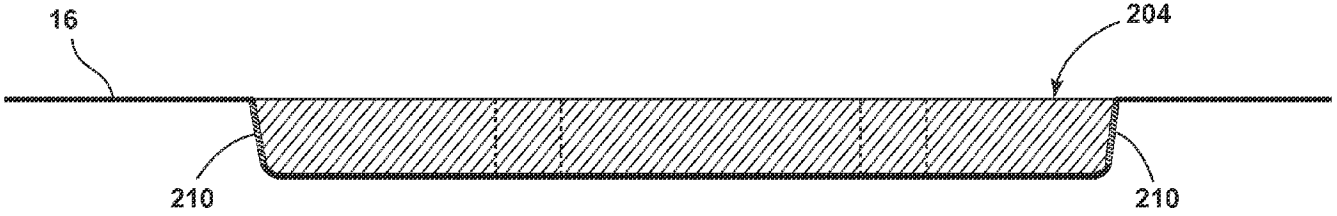

FIGS. 12A and 12B illustrate another alternative embodiment of a setup and method for attaching a bracket 204 to an outer wrapper top wall 16. In this embodiment, the bracket 204 may share selected features with the bracket 36, but may have perimetric outwardly-beveled sidewalls 202. A reinforcing fixture 206 similar to the fixture block 190 may include a recess cavity 192 generally as hereinbefore described. The recess cavity 192 may include perimetric inwardly-beveled sidewalls 203 transitioning to a generally planar recess cavity bottom wall 201.

A process as hereinbefore described, such as HVMF, stamping, drawing, and the like, may be utilized to form the recess 58 in a portion of the outer wrapper top wall 16. The recess 58 may have perimetric inwardly-beveled sidewalls 208 complementary with the outwardly-beveled sidewalls 202 of the bracket 204, and a generally planar recess bottom wall 209 transitioning from the sidewalls 208. The bracket 204 may be moved and supported, generally as described hereinbefore.

Under the influence of an EMF 198, which may be oriented orthogonally to the bracket 204 and the outer wrapper top wall 16, the bracket 204 may be driven into the recess 58, as exemplified by the bracket motion vectors F, toward contact with the bottom wall 209 of the recess 58 as supported by the recess cavity bottom wall 201. When the bracket 204 first moves into the recess 58, there may be no contact between the bracket sidewalls 202 and the recess sidewalls 208 due to the differences in horizontal dimensions as a consequence of the inclination of the sidewalls 202, 208.

As the bracket 36 moves further into the recess 58, the outwardly-beveled sidewalls 202 of the bracket 204 may begin to contact and move along the inwardly-beveled sidewalls 208 of the recess 58, generating progressively greater friction forces, and heat energy, along the interfaces of the sidewalls 202, 208. The friction forces and heat energy may eventually reach a magnitude such that the sidewalls 202, 208 may be welded together along the interfaces in a process known as "parent material joining." In this process, the bracket 36 material and the outer wrapper 12 material may be interlocked at a molecular scale, and may form a perimeter sidewall weldment 210 comprising the outer wrapper top wall 16 and the bracket 36.

Figure 13A:
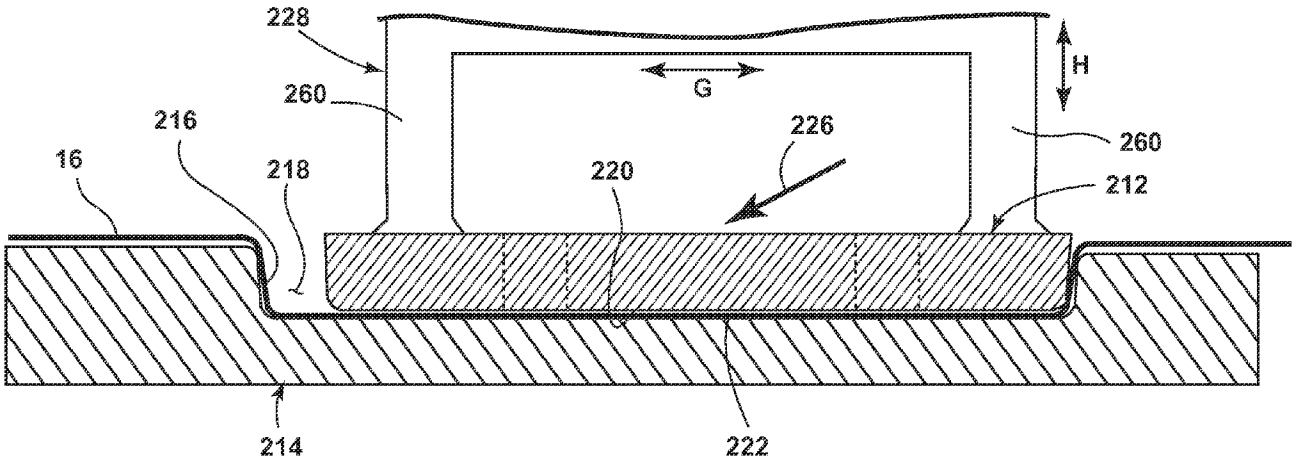
FIG. 13A-B are schematic side views of a bracket bottom wall driven along a recess bottom wall by an inclined HVMF force to generate friction and form a planar weld between the bracket bottom wall and recess bottom wall according to an alternative embodiment of the invention.
Figure 13B:
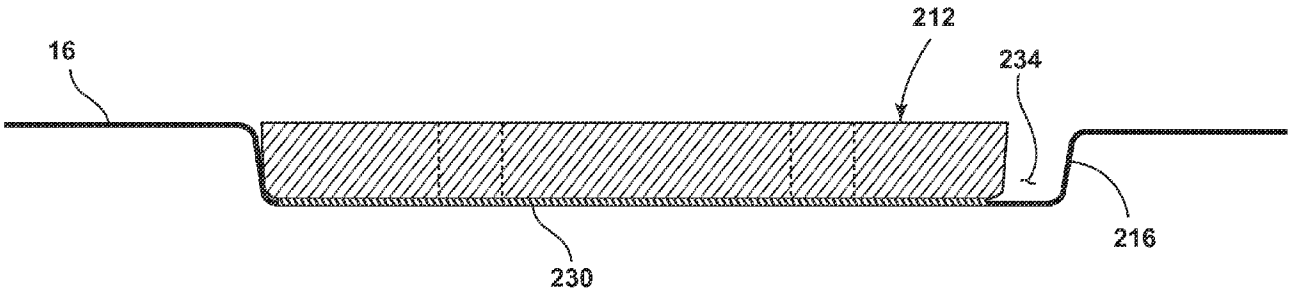

FIGS. 13A and 13B illustrate yet another exemplary embodiment of a setup and method for attaching a bracket 212 to an outer wrapper top wall 16. The bracket 212 may include perimetric sidewalls, which may be generally orthogonal to a bottom wall 220 of the bracket 212. The bracket 212 may be held by the bracket holder 260, which may comprise part of a movable translation fixture 228. A reinforcing fixture 214 may support the outer wrapper top wall 16 during formation of a recess characterized by recess sidewalls 216 transitioning to a recess bottom wall 222. The recess may have a length defining a pre-weld gap 218 between a recess sidewall 216 and a bracket sidewall. The translation fixture 228 and/or the bracket holder 260 may be controllably translatable along up to 3 mutually orthogonal axes, as generally described hereinbefore, to position the bracket 212 over the recess, as exemplified by the motion vectors G and H.

The translation fixture 228 may be capable of high-velocity movement in response to a pulse wave EMF 226 while maintaining a preselected pressure between the bottom wall 220 of the bracket 212 and the recess bottom wall 222. Alternatively, the bracket holder 260 may be capable of high-velocity movement in coordination with, or independently of, movement of the translation fixture 228. The bracket holder 260 may support a pulse wave generator (not shown), which may be configured to selectively move with, or independently of, the bracket holder 260.

The pulse wave EMF 226 may be produced generally as previously described herein, and may be directed at an angle to the plane of the bracket 212. An angle of inclination within a range of 5° to 20° between the pulse wave EMF 226 and the plane of the bracket 212 has been found suitable for the procedure described herein.

The inclined EMF 226 may drive the bracket 212, and the bracket bottom wall 220, both orthogonally against the recess bottom wall 222 as a result of the normal component of the inclined EMF 226, and along the recess bottom wall 222 as a result of a parallel or frictional component of the inclined EMF 226. The magnitude of the frictional component may progressively increase as the bracket 212 is driven against the recess bottom wall 222. Frictional resistance between the bracket bottom wall 220 and the recess bottom wall 222 may result in the generation of heat. Such heat may be substantial, which may facilitate a planar weld of the bracket bottom wall 220 with the recess bottom wall 222. Translation of the bracket 212 may be terminated when the bracket 212 has moved into the pre-weld gap 218 against the recess sidewall 216, leaving a post-weld gap 224.

Figure 14A:
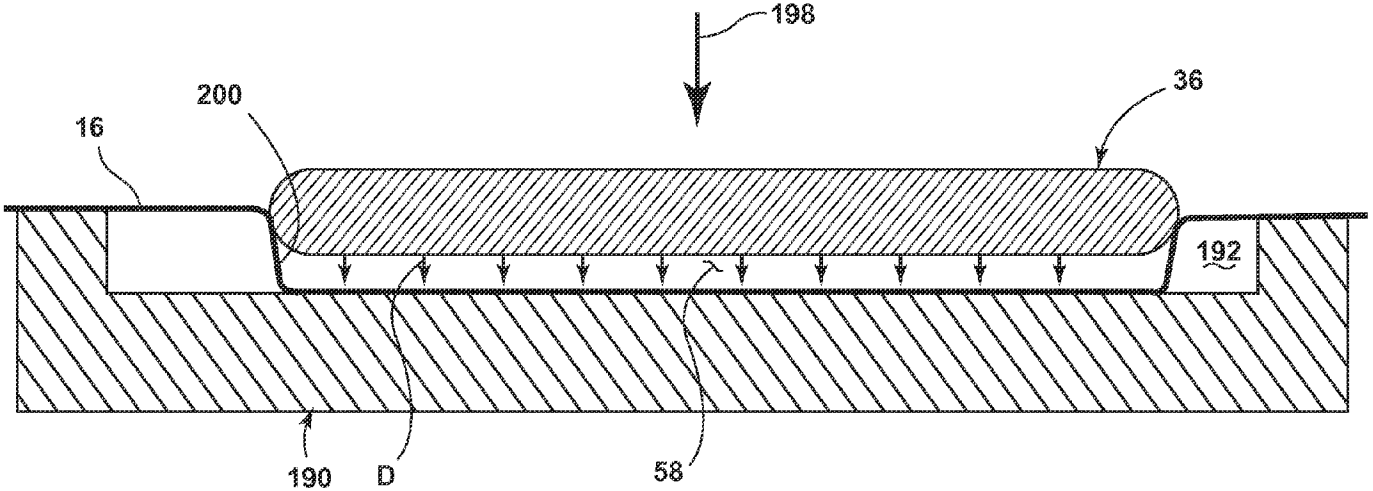
FIG. 14A-B are schematic side views similar to FIGS. 11A-B of a bracket driven into a bracket recess by an HVMF force, followed by a secondary EMF perimeter pulse for overwrapping the bracket walls with portions of the recess sidewalls according to another embodiment of the invention.
Figure 14B:
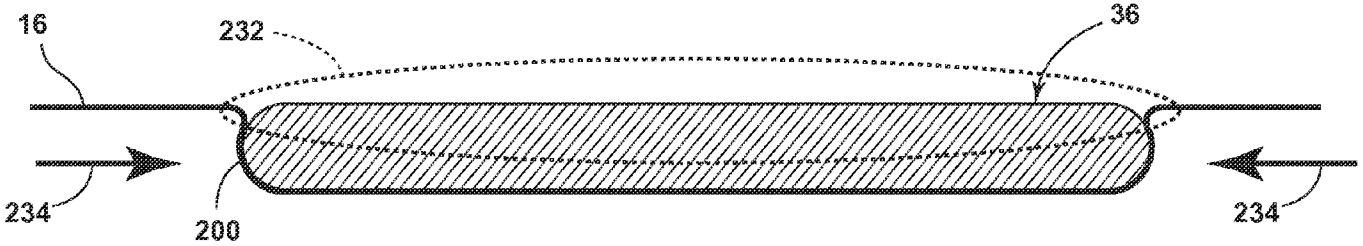

Turning now to FIGS. 14A and 14B, and with reference to FIGS. 2A, 11A, and 11B, the setup and process described with respect to FIGS. 11A and 11B may be modified in order to enhance overwrapping of the outer wrapper top wall 16 with respect to the bracket 36. The setup in FIGS. 14A and 14B may include a secondary inward pulse coil 232 configured to encircle the recess 58 generally along the reverse side of the outer wrapper top wall 16. After the bracket 36 may be driven into the recess 58 by a first pulse wave, as hereinbefore described, a secondary perimetric pulse wave 234 may be directed radially inward from the pulse coil 232. This secondary pulse wave may induce additional plastic flow of the outer wrapper top wall material 200 along and around the sidewalls 39, 40 and projections 37, 38 of the bracket 36 to more tightly join the bracket 36 to the outer wrapper top wall 16.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of making an appliance cabinet, the method comprising:

providing a metallic tub with a recess;

disposing a mounting bracket in the recess and in contact with the metallic tub; and overwrapping a portion of the bracket with a portion of the metallic tub by moving relative to each other one of the mounting bracket or a portion of the metallic tub adjacent to the bracket at a speed great enough to induce plastic flow of the portion of the metallic tub about a portion of the mounting bracket fixedly attach the mounting bracket to the metallic tub.

2. The method of claim 1 wherein the moving step includes applying at least one of a pressure wave or an electromagnetic field to the one of a portion of the metallic tub or the mounting bracket.

3. The method of claim 1 wherein the portion of the mounting bracket is one of a side edge, a bottom, a beveled surface, or a projection from the mounting bracket.

4. The method of claim 3 wherein the projection extends from at least one of a side or bottom of the bracket.

5. The method of claim 4 wherein the projection comprises a beveled surface along the side of the bracket.

6. The method of claim 5 wherein the side is a side edge.

7. The method of claim 1 wherein the mounting bracket comprises a hinge plate, and further comprising attaching the hinge plate near a corner of the cabinet.

8. The method of claim 7 wherein the corner is one of an inner or outer corner of the cabinet.

9. The method of claim 1 wherein the mounting bracket comprises at least one of a hinge plate, a rail assembly, a light fixture support, a door closure magnet, freezer compartment and refrigeration compartment evaporator assemblies, a condenser assembly, a shelving side rail, a glide side adaptor, a water filter housing, a leveler/roller bracket, a compressor mounting plate bracket, a glider rail assembly, a front rail attachment, an inverter module assembly, a high-voltage box assembly, an isolation valve assembly, a control board housing assembly, a needle valve assembly, 2, 3, and 4-way valve assemblies, a suction line attachment, a cantilever shelving hook and ladder bracket, and a water line conduit monoport attachment.

10. The method of claim 1 wherein the attaching comprises flush mounting an upper surface of the mounting bracket with an upper surface of the metallic tub.

11. A method of making a refrigerator cabinet having an inner tub and an outer tub, with at least one of the inner and outer tubs being a metallic tub, and a mounting bracket for mounting a component to the at least one of the inner and outer tubs, the method comprising:

providing the at least one of the inner and outer tubs with a recess;

disposing the mounting bracket in the recess and in contact with the at least one of the inner and outer tubs; and overwrapping a portion of the bracket with a portion of the at least one of the inner and outer tubs by moving relative to each other one of the mounting bracket or a portion of the at least one of the inner and outer tubs adjacent to the bracket at a speed great enough to induce plastic flow of the portion of the at least one of the inner and outer tubs about a portion of the mounting bracket to fixedly attach the mounting bracket to the at least one of the inner and outer tubs.

12. The method of claim 11 wherein moving one of a portion of the at least one of the inner and outer tubs or the mounting bracket comprises applying at least one of a pressure wave or an electromagnetic field to the one of a portion of the at least one of the inner and outer tubs or the mounting bracket.

13. The method of claim 11 wherein the at least one of the inner and outer tubs defines at least a portion of a mullion and the attaching the mounting bracket to the at least one of the inner and outer tubs comprises attaching the mounting bracket to the mullion.

14. The method of claim 13 wherein the mounting bracket comprises a hinge plate.

15. The method of claim 11 further comprising attaching the mounting bracket to a corner of the at least one of the inner and outer tubs.

16. The method of claim 11 wherein both the inner and outer tub are metallic tubs, with the outer tub defining an upper corner and the inner tub defining at least a portion of a mullion, the bracket comprises first and second hinge plates, and the attaching comprises attaching the first hinge plate to the upper corner and the second hinge plate to the mullion.

17. The method of claim 16 further comprising aligning the plates relative to each other prior to the attaching.

18. The method of claim 17 further comprising aligning the hinge plates relative to the cabinet prior to the attaching.

19. The method of claim 11 wherein the attaching comprises flush mounting an upper surface of the mounting bracket with an upper surface of the at least one of the inner and outer tubs.

20. The method of claim 11 wherein the attaching further comprises moving the mounting bracket against the at least one of the inner and outer tubs.

* * * * *